US008474891B2

(12) United States Patent
Shields

(10) Patent No.: US 8,474,891 B2
(45) Date of Patent: Jul. 2, 2013

(54) ZIPPER PULL TOOL

(76) Inventor: Sandra B Shields, New Albany, IN (US)

( * ) Notice: Subject to any disclaimer, the term of this patent is extended or adjusted under 35 U.S.C. 154(b) by 173 days.

(21) Appl. No.: 12/660,550

(22) Filed: Mar. 1, 2010

(65) Prior Publication Data

US 2010/0219650 A1 Sep. 2, 2010

Related U.S. Application Data

(60) Provisional application No. 61/208,865, filed on Feb. 27, 2009.

(51) Int. Cl.
*A44B 19/00* (2006.01)

(52) U.S. Cl.
USPC ..... 294/3.6; 224/269; 294/26

(58) Field of Classification Search
USPC ..... 294/3.6, 26; 224/269, 666–670; 29/7; 248/100, 215, 225.21, 692; 140/80, 81, 81.5; 43/25.2, 34, 43.16, 43.2, 57.1
See application file for complete search history.

(56) References Cited

U.S. PATENT DOCUMENTS

| | | | | | |
|---|---|---|---|---|---|
| 2,233,863 | A | * | 3/1941 | Driscoll | 43/43.16 |
| 2,530,031 | A | * | 11/1950 | Faucette | 119/805 |
| 2,531,981 | A | * | 11/1950 | Liebe | 43/43.16 |
| 2,624,146 | A | * | 1/1953 | Kahle | 43/43.16 |
| 2,887,751 | A | | 5/1959 | Lamb | |
| 3,017,680 | A | | 1/1962 | Duncan | |
| 3,145,041 | A | * | 8/1964 | Grolig | 294/3.6 |
| 3,249,977 | A | * | 5/1966 | Cloud, Sr. | 294/3.6 |
| 3,310,853 | A | | 3/1967 | Winn | |
| 3,348,870 | A | | 10/1967 | Zern | |
| 3,354,520 | A | | 11/1967 | Morgen | |
| D273,075 | S | * | 3/1984 | Hayden | D7/683 |
| D296,882 | S | | 7/1988 | Lopez | |
| 5,100,191 | A | | 3/1992 | Detrick et al. | |
| 5,115,594 | A | * | 5/1992 | Gowing | 43/44.82 |
| D330,492 | S | * | 10/1992 | Brown | D7/683 |
| D401,389 | S | | 11/1998 | Taylor et al. | |
| D406,685 | S | | 3/1999 | McGinnis | |
| 5,975,386 | A | | 11/1999 | Fernicola | |
| 6,164,169 | A | | 12/2000 | Goff | |

(Continued)

*Primary Examiner* — Saul Rodriguez
*Assistant Examiner* — Gabriela Puig
(74) *Attorney, Agent, or Firm* — Carrithers Law Office PLLC

(57) ABSTRACT

A tool is disclosed herein for facilitating the opening and closing of mail bags, money bags, tool bags, and other large bags for carrying heavy loads utilizing large zippers. For instance, mail bags have a large zipper closure. Mail workers open and close these zippers dozens of times a day. Frequently, the zippers are hard to operate. Sometimes, the zipper handle may be missing. In both of these cases, a tool of some sort would facilitate the opening and closing of the bag. The present invention provides a zipper pull tool comprising a handle with a hook disposed at a selected optimal angle with a wedge shaped distal end and an eyelet or loop disposed at the other end. The handle is economically designed to provide good grip yet not require the user to squeeze the handle minimizing risk of injury to the wrist due to repetitive motions. The hook is disposed at such an angle as to provide optimum ease for hooking to the zipper or zipper handle. The loop on the end of the tool is attached to one end of an elastic safety laniard which is removably attached to the user's clothing. A safety clip attached to the other end of the laniard will allow the laniard and tool to be safely pull loose from the clothing in the event of an emergency.

2 Claims, 4 Drawing Sheets

U.S. PATENT DOCUMENTS 6,312,030 B1 * 11/2001 Johannes et al. ..... 294/26
6,464,271 B1 * 10/2002 Irvin, Jr. ..... 294/26
D476,136 S 6/2003 Nahum
7,841,496 B1 * 11/2010 Schweikert ..... 224/150
2005/0067846 A1 3/2005 Tempkins
2005/0199663 A1 * 9/2005 Heaton et al. ..... 224/269
2006/0124676 A1 * 6/2006 Mastrosimone ..... 224/257
2007/0119018 A1 5/2007 Snyder

* cited by examiner

ZIPPER PULL TOOL

CROSS REFERENCE TO RELATED APPLICATIONS

This application claims priority from U.S. Provisional Application Ser. No. 61/208,865 filed on Feb. 27, 2009.

TECHNICAL FIELD

The present invention relates to the field of tools used to facilitate the opening and closing of zippers. In particular, this tool is meant to be used for heavy duty zippers used on heavy canvas mail bags but could find use on other industries or commercial activities as well.

DESCRIPTION OF THE RELATED ART

U.S. Pat. No. 3,310,853 by Winn for "DEVICE FOR OPERATING ZIP FASTENERS" which issued Mar. 28, 1967 discloses a zipper pull device comprising a rod with a handle disposed on one end and a hook disposed on the other, and also including a spreader which keeps the cloth covering the zipper from becoming entangled in the device. U.S. Pat. No. 2,887,751 by Lamb for "LADIES' ZIPPER PULLER" which issued May 26, 1959 discloses a cord with a ring type handle disposed at one end and disposed at the other end is a rigid channel shaped member comprising a hook disposed between the flanges of the channel for hooking the zipper. Neither of these discloses a hook disposed at an angle which makes the hooking step easier to accomplish. Nor does either disclose a handle ergonomically designed for hard pulling and for multiple use throughout the day. An elastic laniard for ease of use is not provided. Finally, a safety clip which provides automatic detaching of the device in an emergency is not disclosed in either these. These four elements are not disclosed in any of the other related art known to the inventor.

BACKGROUND OF THE INVENTION

Large zipper bags are used by the US Mail Service, UPS, Federal Express, banks, federal reserve, the armed forces, industries, and other commercial groups for transportation and storage of mail and other parcels and goods throughout the world. These bags are large and heavy and require heavy zippers as a closure. Consequently, these zippers are hard to operate and can cause hand, finger, wrist and arm stress and strain injuries. An easy to use tool is needed to facilitate zipper operation and remedy the stress and strain issues. Such a tool is provided in the present invention.

A zipper pull tool is disclosed in the present invention comprising a handle, with a hook disposed at a first end of said handle, the end section of said hook is canted at an angle of between 25 and 40 degrees as measured from a longitudinal axis of said handle. The handle is ergonomically designed for heavy and frequent use to relieve stress and strain and possible repetitive motion ailments. The zipper pull tool also comprises a loop disposed at a second end of said handle with said loop being connected to a first end of an elastic laniard and a clip connected to a second end of said laniard, said clip capable of gripping and holding the clothing of a user. Said laniard contains a safety breakaway coupling capable of being pulled apart with a pull of at least 1 pound. This coupling provides a measure of safety for a user who may be working in close proximity to possibly dangerous conveyors and other equipment in motion.

SUMMARY OF THE INVENTION

A tool is provided herein which enables the user to easily open and close heavy duty and hard to pull zippers on mail bags. The present invention provides a zipper pull tool comprising a handle with a hook disposed at an angle on one end and an eyelet or loop disposed at the other end. The end portion of the hook is disposed at such an angle as to make it easy to hook onto the zipper or zipper handle. The loop on the end of the tool is attached to one end of an elastic safety laniard which is removably attached to the user's clothing. A safety clip attached to the other end of the laniard will allow the laniard and tool to safely break away from the clothing in the event of an emergency.

It is an object of this invention to provide a tool which eases the operation of heavy duty zippers on mail bags and the like.

It is an object of this invention to provide a tool which has an ergonomically designed handle for comfortable and safe use.

It is an object of this invention to provide a tool which has a hook disposed at an optimum angle for hooking the zipper or zipper handle.

It is an object of this invention to provide a tool which is suspended by an elastic laniard for ease of use, transport and storage of the tool.

A tool is disclosed herein for facilitating the opening and closing of mail bags, money bags, tool bags, body bags, and other large bags for carrying heavy loads utilizing large zippers.

It is an object of this invention to provide a tool with a laniard and a clip which easily connects to and is held on to the user's clothing for ease of use and storage of the tool.

It is an object of this invention to provide a tool with a laniard and a clip which snugly holds the laniard to the user's clothing but will safely pull loose from the user in the case of an emergency.

It is an object of this invention to provide a zipper pull and detachable break-away belt clip.

It is an object of this invention to provide a zipper pull with an ergonomic handle and hook having a curved offset angled wedge shaped distal end.

It is an object of this invention to provide a zipper pull having a tapered wedge shaped distal end of the hook.

It is an object of this invention to provide a zipper pulls with a detachable break-away laniard.

It is an object of this invention to provide a laniard showing a spring clip cooperatively engaging the pin and washer holding means.

It is an object of this invention to provide a detachable break-away clip and laniard spring clip cooperatively engaging the pin and washer holding means.

It is an object of this invention to provide a detachable break-away clip using velcro in place of the spring clip to connect the laniard to the belt clip.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
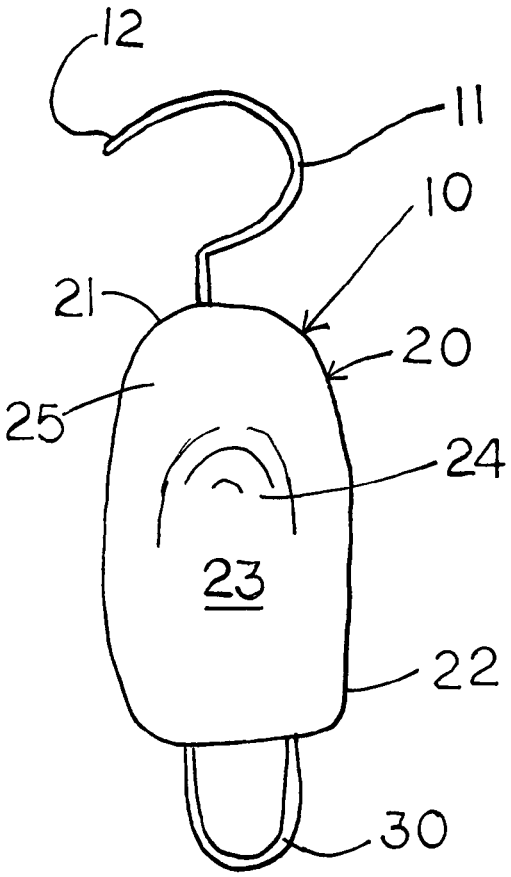
FIG. 1 is an front view of a zipper pull with hook and loop.
Figure 2:
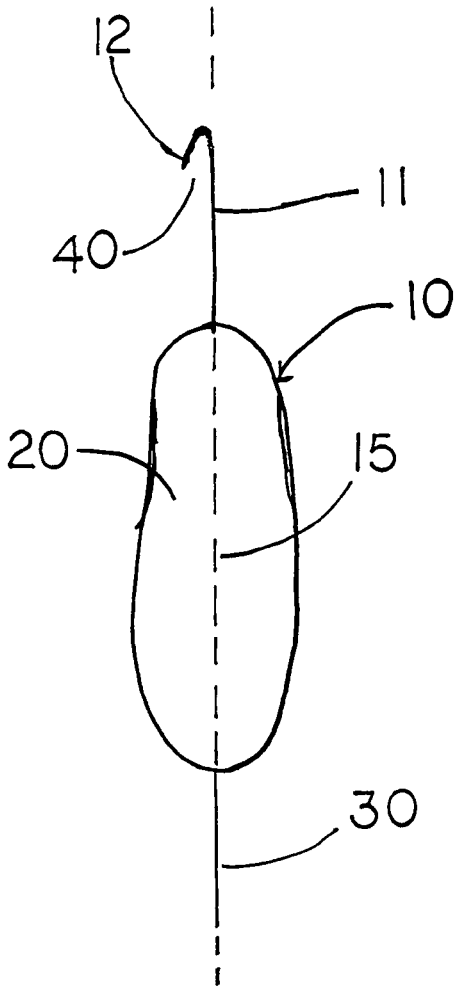
FIG. 2 is a left side view of a zipper pull also showing the angle 40 of the hook portion with the longitudinal axis 15 of the handle.
Figures 3, 4:
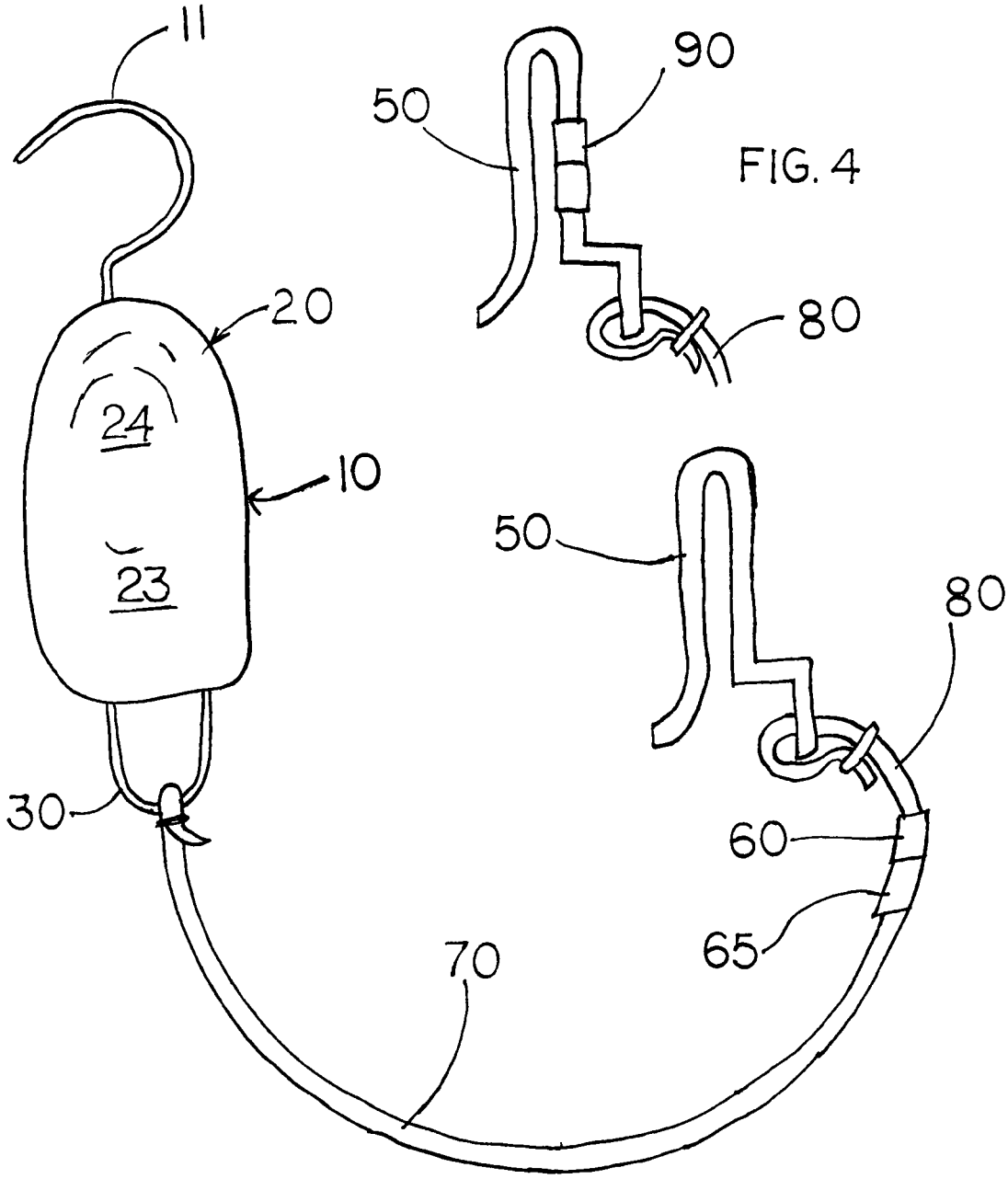
FIG. 3 is a front view of the zipper pull with laniard, breakaway coupling and belt clip.
FIG. 4 is front view of a two part elastic laniard connecting the handle loop to the belt clip.
Figure 5:
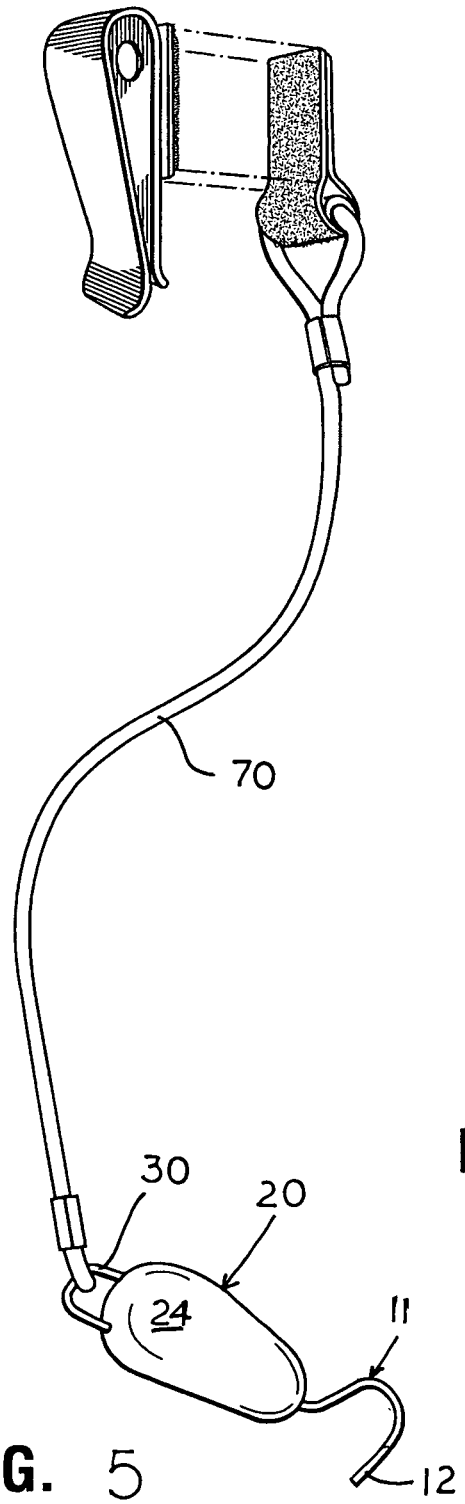
FIG. 5 is a perspective view of the present invention showing the zipper pull having a depression to accommodate the user's thumb and a breakaway laniard using a clip and hook and loop fastener.
Figure 6:
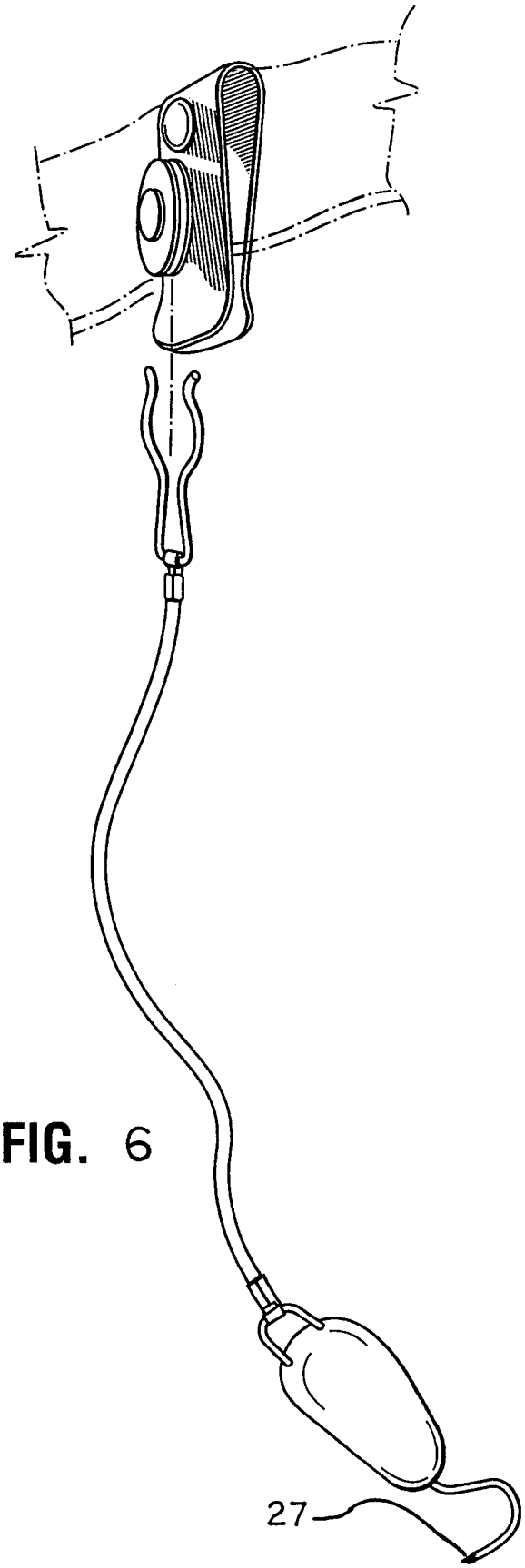
FIG. 6 is a perspective view of the present invention showing the zipper pull having a depression to accommodate the user's thumb and a breakaway laniard using a clip and a spring clip and snap ring.
Figure 7:
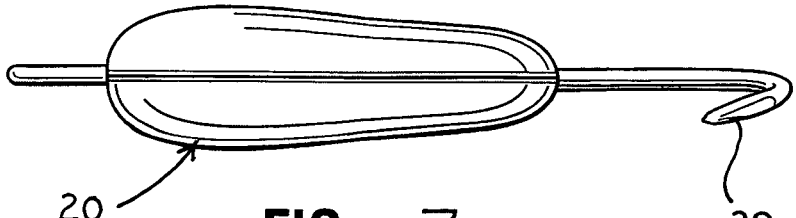
FIG. 7 is a perspective view of the zipper pull of the present invention showing the angle of the hook and wedge shaped distal end.
Figure 8:
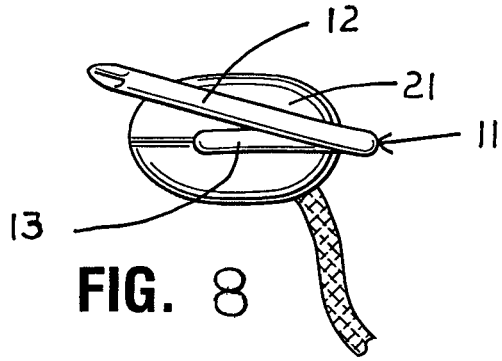
FIG. 8 is a front perspective view of the zipper pull of the present invention showing the angle of the hook and wedge shaped distal end.
Figure 9:
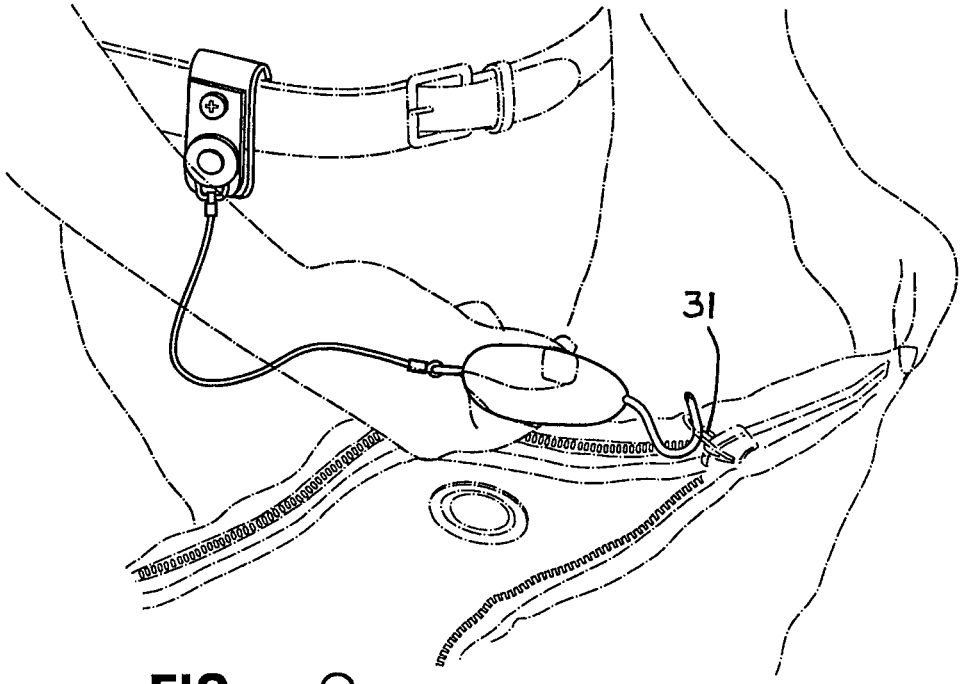
FIG. 9 is a perspective view of the zipper pull and laniard of the instant invention with the breakaway laniard shown attached to a users belt in phantom lines and the zipper pull hooked into the loop of a zipper and the ergonomic grasp of the tool by the user.

In accordance with the present invention, there is provided a zipper pull tool. FIGS. 1-9 show zipper pull tool 10 of the present invention comprising an ergonomically designed handle 20 with a hook 11 disposed at one end and means for holding defining a loop 30 at the opposing end for connection to a laniard comprising a rope, cord, string, wire, or other means of flexible attachment.

More particularly, as best shown in FIGS. 5-9 the handle 20 defines an ergonomic elongated oblong member 20 having generally rounded ends. The front oblong end 21 from which the hook 11 extends is smaller than the rear oblong end 22 to which the means such as the loop 30 for connecting to the lanyard 70 is attached. The handle 20 is not cylindrical, but wider than it is thick whereby the sides 23 are generally planar in cross-sectional shape. On at least one of the planar sides 23, and preferably both, include a thumb depression 24 to enhance the grip of the user. The size of the handle 20 is available in more than one size in order that the user can comfortably grip the handle 20 and pull the zipper of a bag without requiring excessive squeezing of the handle 20 which tends to exert stress on the risk of the user leading to injury with repetitive use. The thinner and narrower front portion 25 of the handle 20 facilitates a quick grip and orientation of the zipper pull 10 in order that the user can orient the zipper pull 10 correctly without having to look at the handle 20 to orient the tool before use.

As best illustrated in FIGS. 5-9, the tip of the hook is wedge shaped to easily be twisted and slipped into the eyelet of the zipper. The eyelets are typically square or rectangular in shape. Although a round hook having a pointed distal end 27 would be acceptable in most applications, a wedge shaped distal end 29 is advantageous in that a slight twist or turn aids in slipping the tip into the zipper eyelet 31 especially if the hook within the eyelet is a snug fit.

FIGS. 5-9 clearly illustrate that the distal end portion of the hook 11 forming the tip 12 is not coplanar with the body 13 of the hook, but is disposed at an offset angle, preferably up to 60 degrees, more preferably up to 40 degrees and more preferably in a range of from about 25 to 40 degrees measured with respect to a longitudinal axis 15 of the handle 20. This offset angle promotes easier hooking into the zipper loop.

The loop 30 and hook 11 can be formed as an integral piece and embedded or molded into the handle 20 for maximum structural strength. Of course it is contemplated that the hook 11 and loop 30 may be two separate pieces molded into the handle body or affixed thereto by threaded ends, glue or the like.

A two part elastic laniard 70, 80 connects the handle loop 30 to the belt clip 50. The laniard parts 70 and 80 are connected to each other with breakaway means such as a two part breakaway coupling 60, 65. The two part breakaway coupling 60, 65 is capable of being pulled apart with a pull of at least 1 pound. This is a safety precaution for users working around conveyors or the like who might get their hook caught in a moving part. Preferably the lanyard hangs down from the user's belt a short distance which may be adjustable in order that the user grip the zipper pull tool 10 with one hand.

Another embodiment of the pull tool may have a one piece laniard and contain a belt clip with a breakaway device 90 integral within the clip 50 and capable of breaking away with a pull of at least 1 pound.

The handle may be composed of any rigid or semi-rigid material such as wood, plastic, resins, metals, etc. The hook and loop would preferably be metal but any sufficiently rigid and strong material may be used. The laniard may be made from any elastomeric fibers or cords deemed to be strong enough. The belt clip may be composed of plastic, resins, metal or any other material which is sufficiently strong.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A zipper pull tool consisting of:

a handle including a thumb recess formed on a selected surface thereof;

a hook disposed at a first end of said handle;

said hook comprising a body and a tip including a distal end defining a wedge having a tapered distal end;

said hook tip and said hook body are offset an angle with respect to one another;

said distal end of said tip is offset from said hook canted at an angle of between 25 and 40 degrees as measured from a longitudinal axis of said handle;

a loop disposed at a second end of said handle, said loop connecting to a first end of an elastic laniard and a clip being connected to a second end of said laniard, said clip capable of detachably gripping and holding the clothing of a user;

said clip contains an integral breakaway device.

2. A zipper pull tool assembly, consisting of:

a) a handle including a generally planar side including a thumb depression for orienting said handle wherein said a user can orient said zipper pull tool correctly without having to look at said handle prior to use, said handle defining an elongated oblong member having a generally rounded distal rear end and a smaller proximate front end;

a hook projecting from said smaller proximate front end of said handle;

said hook comprising a body and a tip including a distal end defining a wedge having a tapered end;

said hook tip and said hook body are not coplanar, but offset an angle;

and said distal end of said tip is offset from of said hook canted at an angle of up to 60 degrees as measured from a longitudinal axis of said handle;

a loop disposed at said distal rear end of said handle, said loop connecting to a first end of a laniard and a clip connecting to a second end of said laniard; and a bag including a zipper having an eyelet cooperatively engagable with said hook of said zipper pull tool.

* * * * *